US006692029B2

(12) United States Patent
Ke

(10) Patent No.: US 6,692,029 B2
(45) Date of Patent: Feb. 17, 2004

(54) FOLDER APPARATUS

(75) Inventor: Yu-Chia Ke, Taipei (TW)

(73) Assignee: Your Everyday Stationary Ind.. Co., Ltd., Taichung Hsien (TW)

( * ) Notice: Subject to any disclaimer, the term of this patent is extended or adjusted under 35 U.S.C. 154(b) by 0 days.

(21) Appl. No.: 10/104,115

(22) Filed: Mar. 22, 2002

(65) Prior Publication Data

US 2003/0178838 A1 Sep. 25, 2003

(51) Int. Cl.[7] ..... B42D 1/00

(52) U.S. Cl. ..... 281/21.1; 24/67 R; 281/29; 402/70; 402/73; D19/26

(58) Field of Search ..... 281/21.1, 29, 36, 281/51; 402/73, 75, 80 R, 70, 500, 502, 2, 8; D19/26, 27; 24/67 R, 67.11, 67 P

(56) References Cited

U.S. PATENT DOCUMENTS 1,427,397 A * 8/1922 Kilfoyle ..... 24/67 R
1,683,238 A * 9/1928 Cardoza ..... 281/47
2,888,934 A * 6/1959 Segal ..... 402/37
4,571,109 A * 2/1986 Lapertosa ..... 402/77
4,681,474 A * 7/1987 Wiberg ..... 402/75
5,120,149 A * 6/1992 Smith ..... 402/75
5,718,530 A * 2/1998 Tibbetts ..... 402/73
6,419,416 B1 * 7/2002 Tomoda ..... 402/18

* cited by examiner

*Primary Examiner*—Monica S. Carter
(74) *Attorney, Agent, or Firm*—Alan Kamrath; Rider Bennett, LLP

(57) ABSTRACT

A folder apparatus includes a folder, a holder for holding leaves and a connector for attaching the holder to the folder in a detachable manner. The holder includes a number of hooks formed thereon. The folder includes two covers and an intermediate panel interconnecting the covers. The connector is formed on the intermediate panel. In a first aspect, the holder includes a base attached to the intermediate panel in a detachable manner by means of the connector. The base includes two ends. The connector includes two clips formed on the intermediate panel for engagement with the ends of the base of the holder. In a second aspect, the connector is a hook-and-loop device.

7 Claims, 8 Drawing Sheets

FOLDER APPARATUS

BACKGROUND OF INVENTION

1. Field of Invention

The present invention is related to a folder and, more particularly, to a folder apparatus being capable of holding various types of leaves.

2. Related Prior Art

Folders are used in offices to hold leaves of documents. Referring to FIG. 7, a conventional folder 1 is shown. The conventional folder 1 includes two covers (not numbered) connected with each other via an intermediate panel 2. A holder 3 is secured to the intermediate panel 2 by means of three rivets 4. Two pairs of hooks 5 are mounted on the holder 3. The conventional folder 1 is capable of holding leaves with two holes defined therein. However, there are various types of leaves. Each type includes a different number of holes defined therein. A leaf in which a number of holes are defined can only be held by means of a conventional folder equipped with the same number of pairs of hooks. For instance, a leaf in which four holes are defined can only be held by means of a conventional folder equipped with four pairs of hooks. A leaf in which twelve holes are defined can only be held by means of a conventional folder equipped with twelve pairs of hooks. To hold different types of leaves, different conventional types of folders must be used, thus increasing the cost for management of documents.

FIG. 8 is a top view of a box (not numbered) containing a few conventional folders 1. As mentioned, the holder 3 is secured to the intermediate panel 2 of each conventional folder 1, thus inevitably keeping an edge of a cover from an edge of the other cover by a distance identical to the width of the intermediate panel 2. Each conventional folder 1 cannot be further folded, i.e., a cover cannot be moved against the other cover. Thus, only a few conventional folders 1 can be packed in a box for storage. The cost for storing and/or transportation of such conventional folders is inevitably high.

The present invention is therefore intended to obviate or at least alleviate the problems encountered in use, storage and/or transportation of conventional folders.

SUMMARY OF INVENTION

It is an objective of the present invention to provide a folder apparatus that is capable of holding various types of leaves.

It is another objective of the present invention to provide a folder apparatus that is foldable so that a large number of such folder apparatuses can be packed in a box.

In the present invention, a folder apparatus includes a folder, a holder for holding leaves and a connector for attaching the holder to the folder in a detachable manner. The holder includes a number of hooks formed thereon. The folder includes two covers and an intermediate panel interconnecting the covers. The connector is formed on the intermediate panel.

In a first aspect, the holder includes a base attached to the intermediate panel in a detachable manner by means of the connector. The base includes two ends. The connector includes two clips formed on the intermediate panel for engagement with the ends of the base of the holder.

In a second aspect, the connector is a hook-and-loop device.

Other objectives, advantages, and novel features of the invention will become more apparent from the following detailed description when taken in conjunction with the accompanying drawings.

BRIEF DESCRIPTION OF THE DRAWINGS

The present invention is described through detailed illustration of embodiments referring to the attached drawings wherein.

DETAILED DESCRIPTION OF PREFERRED EMBODIMENT

Figure 1:
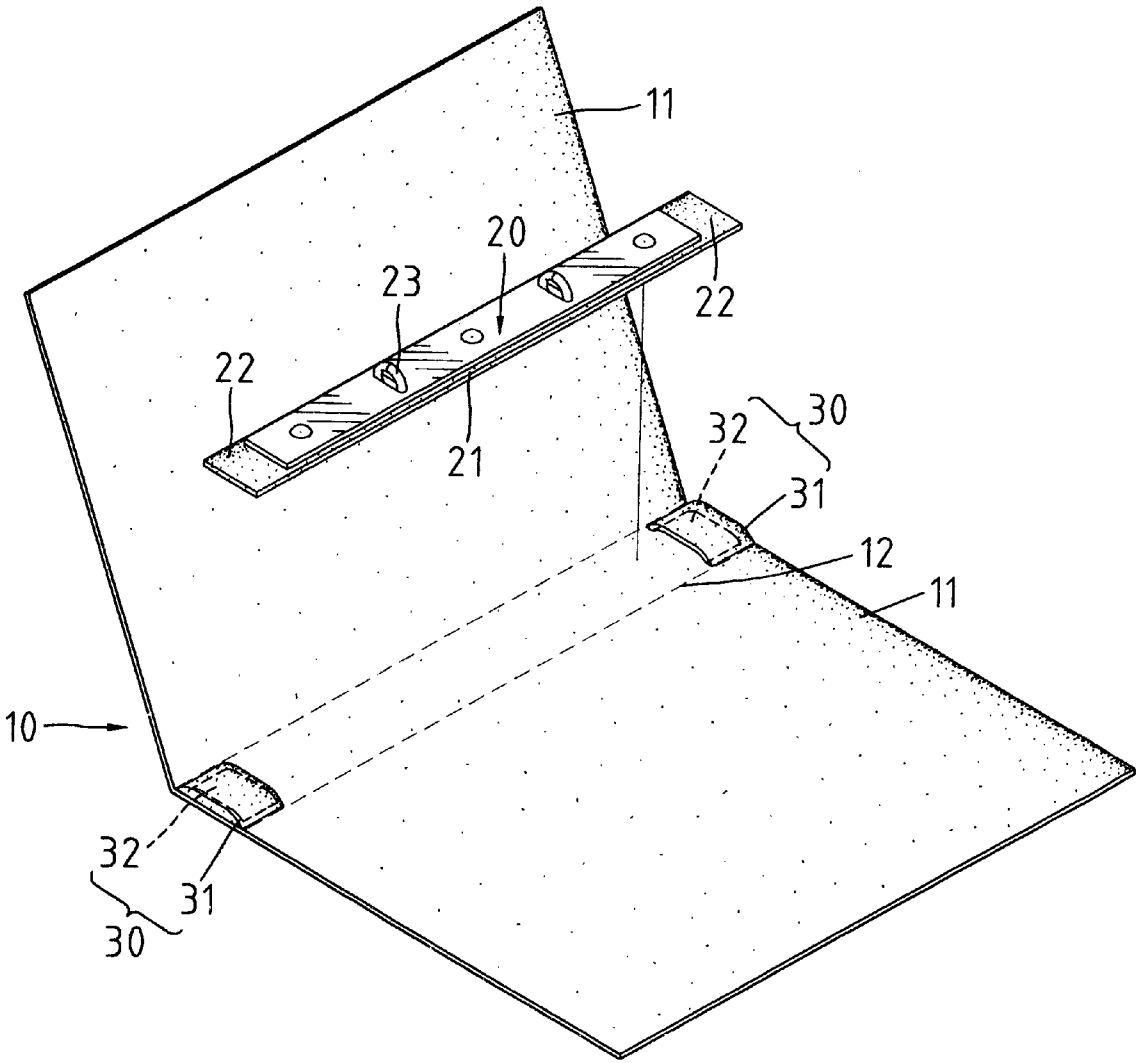
FIG. 1 is an exploded view of a folder apparatus of the present invention.

Referring to FIG. 1, according to the present invention, a folder apparatus includes a folder 10, a holder 20 and a connector 30 for attaching the holder 20 to the folder 10 in a detachable manner.

The folder 10 includes two covers 11 connected with each other via an intermediate panel 12.

The holder 20 includes a base 21. The base 21 may be a laminate consisting of a first strip (not numbered) and a second strip (not numbered). The first strip is secured to the second strip by means of three rivets (not numbered). The second strip includes two ends 22. Two pairs of hooks 23 are formed on the first strip of the base 21. A holder of this type is suitable for holding leaves that include two holes defined therein.

The connector 30 includes two clips 31 formed on the intermediate panel 12 at two ends. Thus, a space 32 is defined between each of the clips 31 and the intermediate panel 12.

Figure 2:
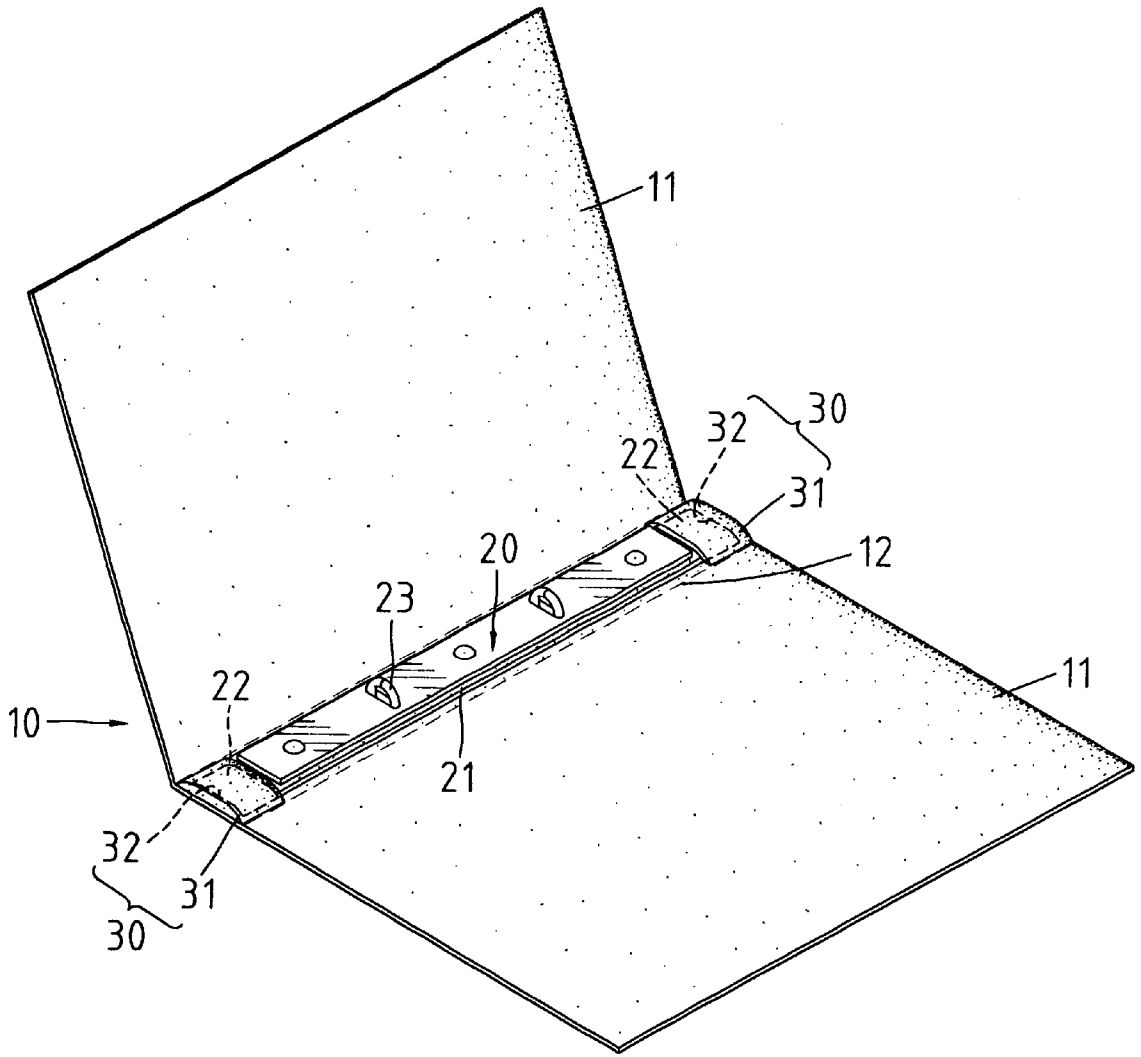
FIG. 2 is a perspective view of the folder apparatus of the present invention equipped with a first type of holder for holding leaves of a first type.

To attach the holder 20 to the folder 10, the base 21 made with elasticity is bent so that its ends 22 can be inserted into the spaces 32 as shown in FIG. 2. After the insertion of the ends 22 in the spaces 32, the base 21 is released so that the ends 22 are engaged with the clips 31. Thus, the holder 20 is attached to the folder 10. It is obvious that the holder 20 can be removed from the folder 10 easily.

Figure 3:
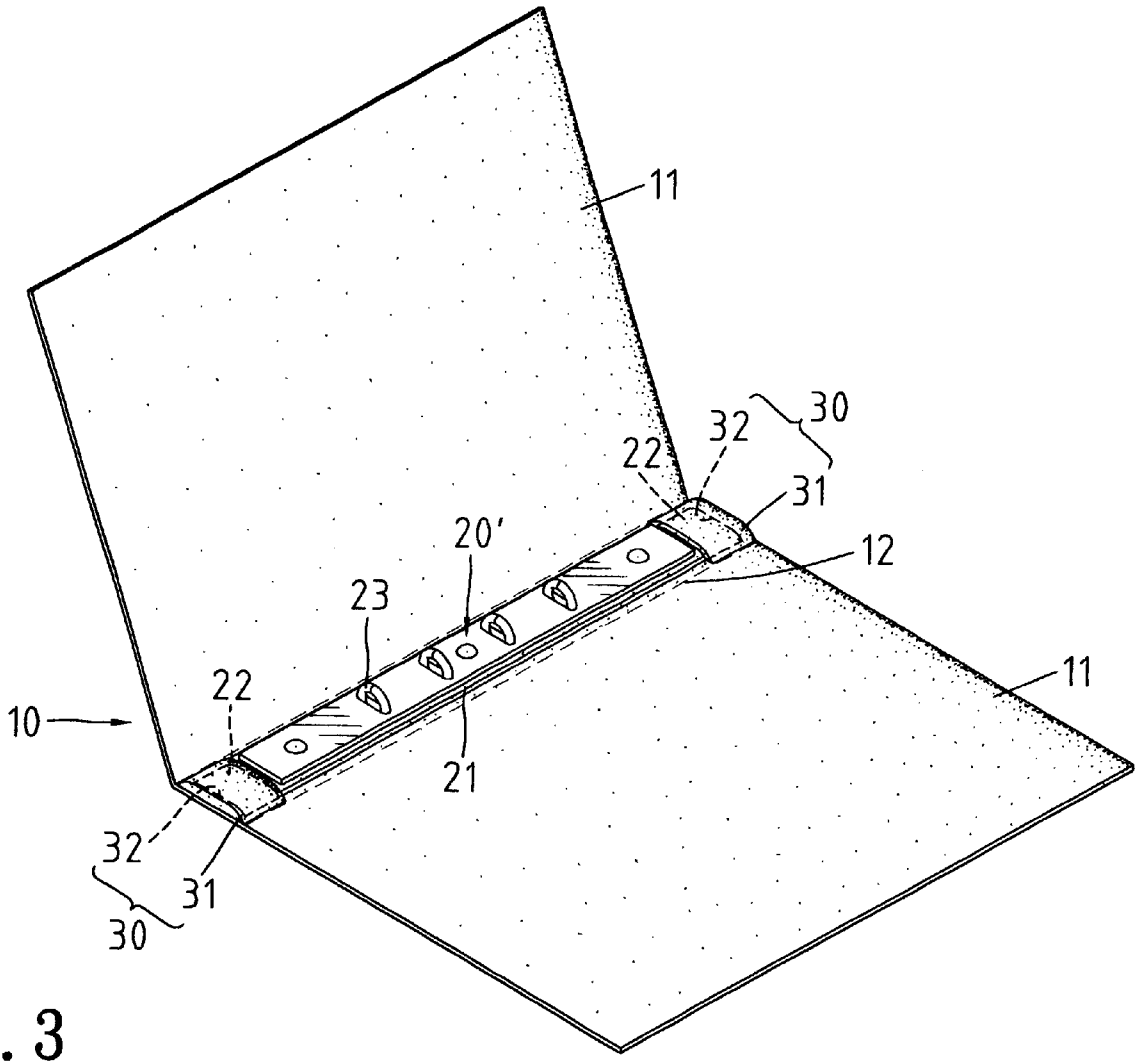
FIG. 3 is a perspective view of the folder apparatus of the present invention equipped with a second type of holder for holding leaves of a second type.

Referring to FIG. 3, the folder 10 is equipped with another type of holder 20' on which four pairs of hooks 23 are formed. The holder 20' is suitable for holding leaves that include four holes defined therein.

Figure 4:
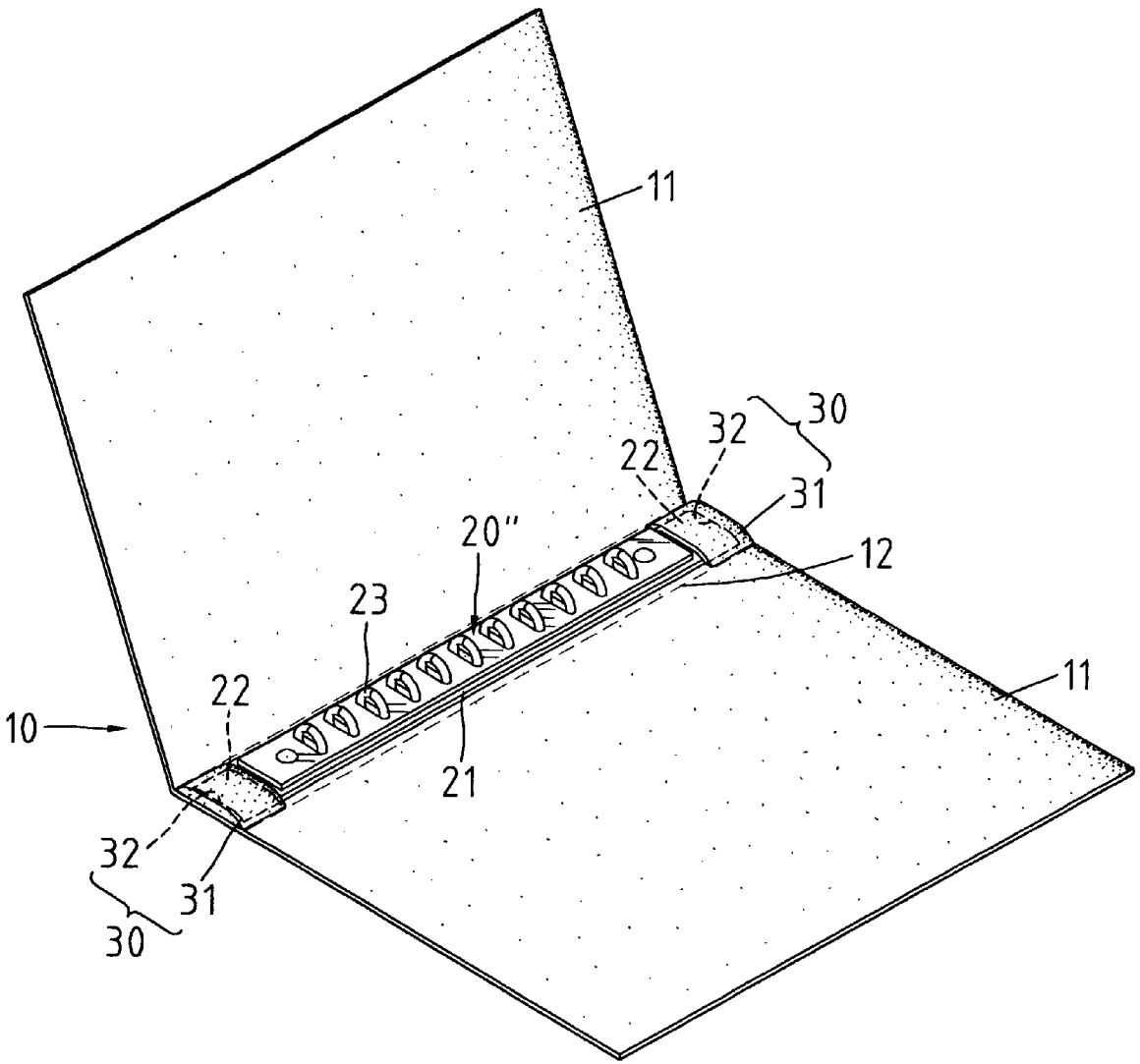
FIG. 4 is a perspective view of the folder apparatus of the present invention equipped with a third type of holder for holding leaves of a third type.

Referring to FIG. 4, the folder 10 is equipped with another type of holder 20" on which twelve pairs of hooks 23 are formed. The holder 20" is suitable for holding leaves that include twelve holes defined therein.

Figure 5:
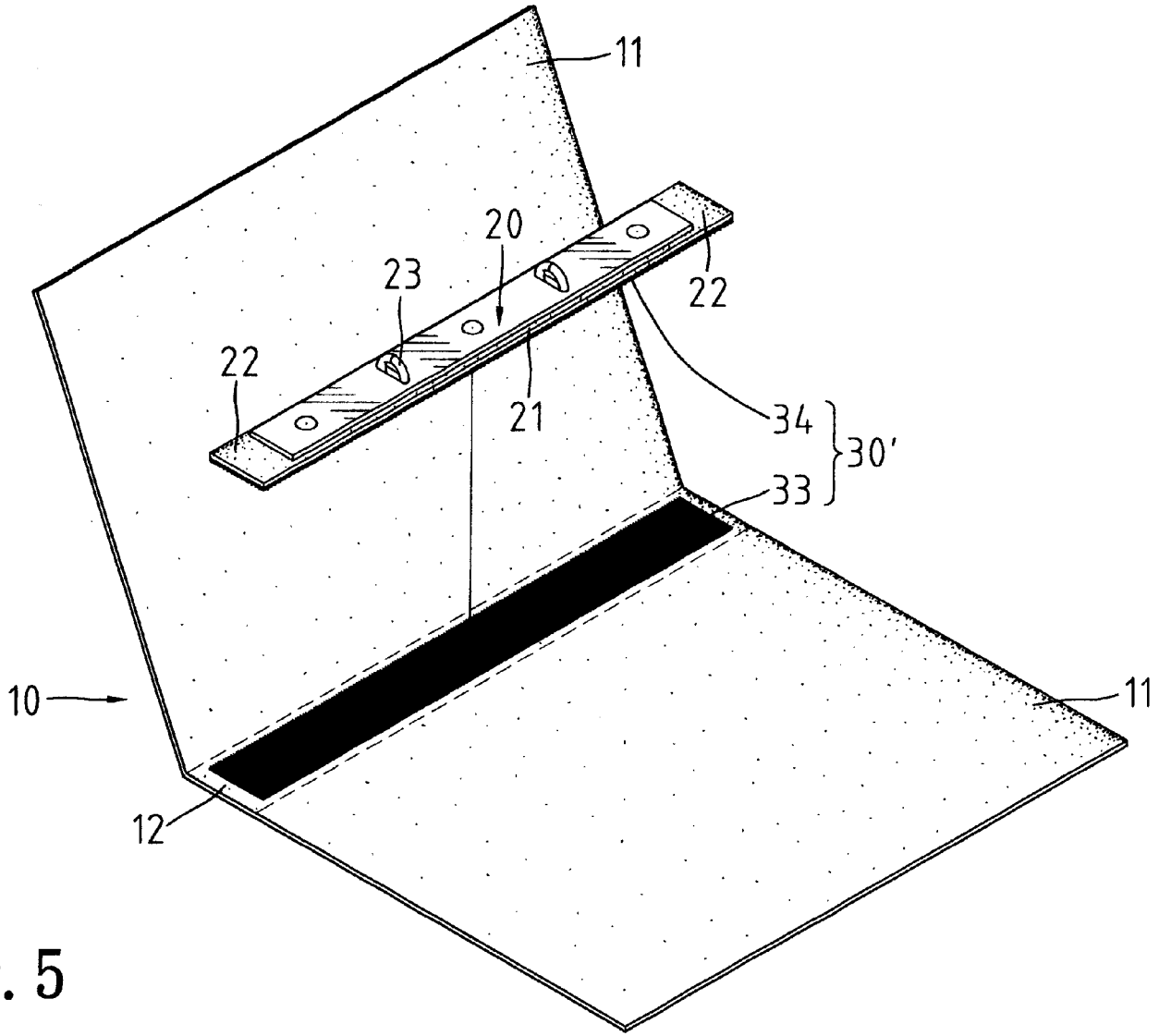
FIG. 5 is an exploded view of a folder apparatus according to a second embodiment of the present invention.

Referring to FIG. 5, a folder apparatus according to a second embodiment of the present invention includes a folder 10, a holder 20 and a connector 30' for attaching the holder 20 to the folder 10 in a detachable manner. The folder 10 and the bolder 20 will not be described in detail with respect to this embodiment since they have been described in detail with reference to the embodiments of FIGS. 1–4. The connector 30' is a hook-and-loop device. The hook-and-loop device consists of a first strip 33 and a second strip 34. The first strip 33 is secured to the intermediate panel 12 on a side and formed with a number of hooks or loops (not numbered) on an opposite side. The second strip 34 is secured to the base 21 on a side and formed with a number of loops or hooks (not numbered) on an opposite side. Thus, the first strip 33 can be engaged with and disengaged from the second strip 34, i.e., the holder 20 can be attached to and detached from the folder 10. The hook-and-look device is conventional and therefore will not be described in detail.

Figure 6:
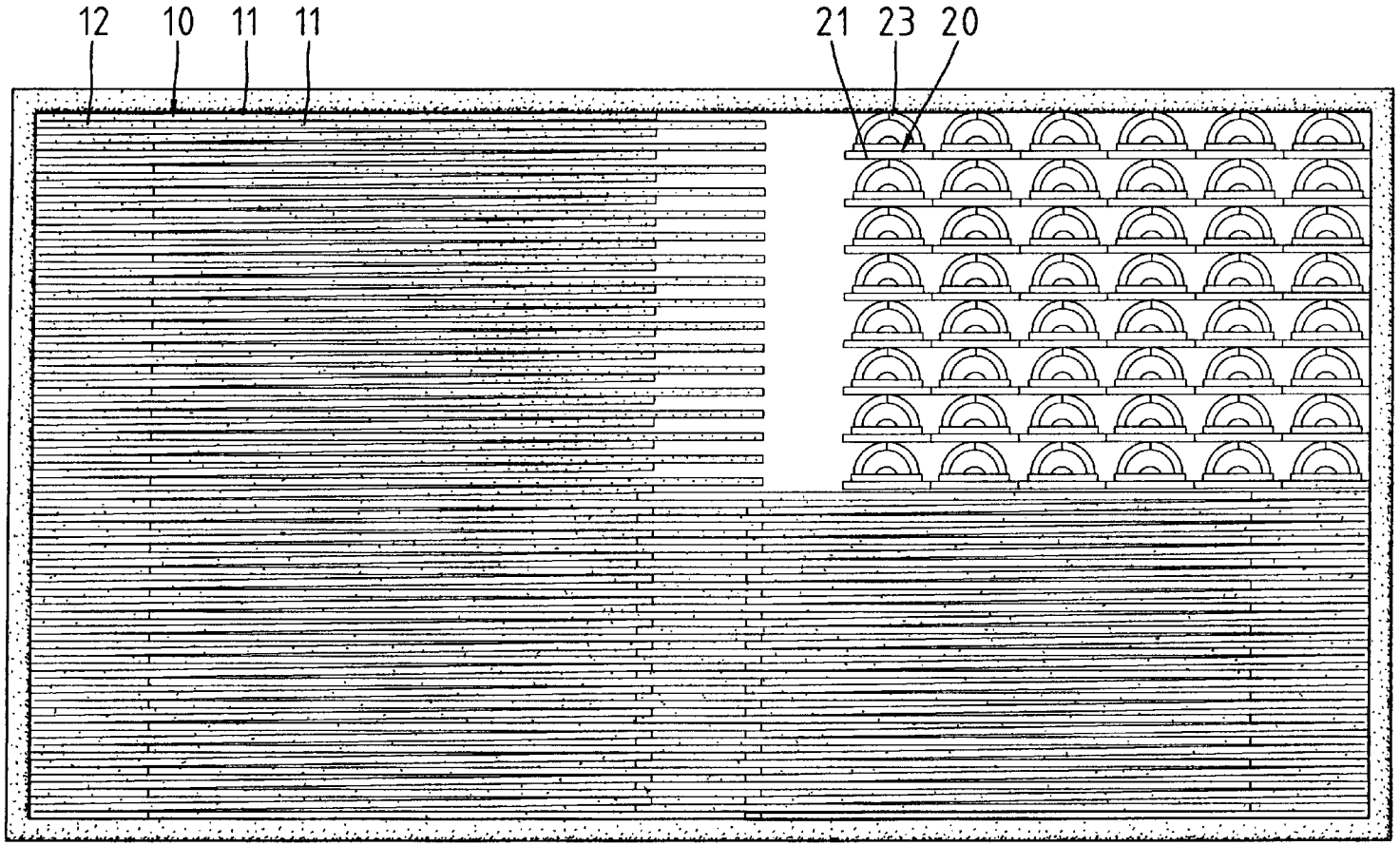
FIG. 6 is a top view of a box containing a large number of folder apparatuses of the present invention.
Figure 7:
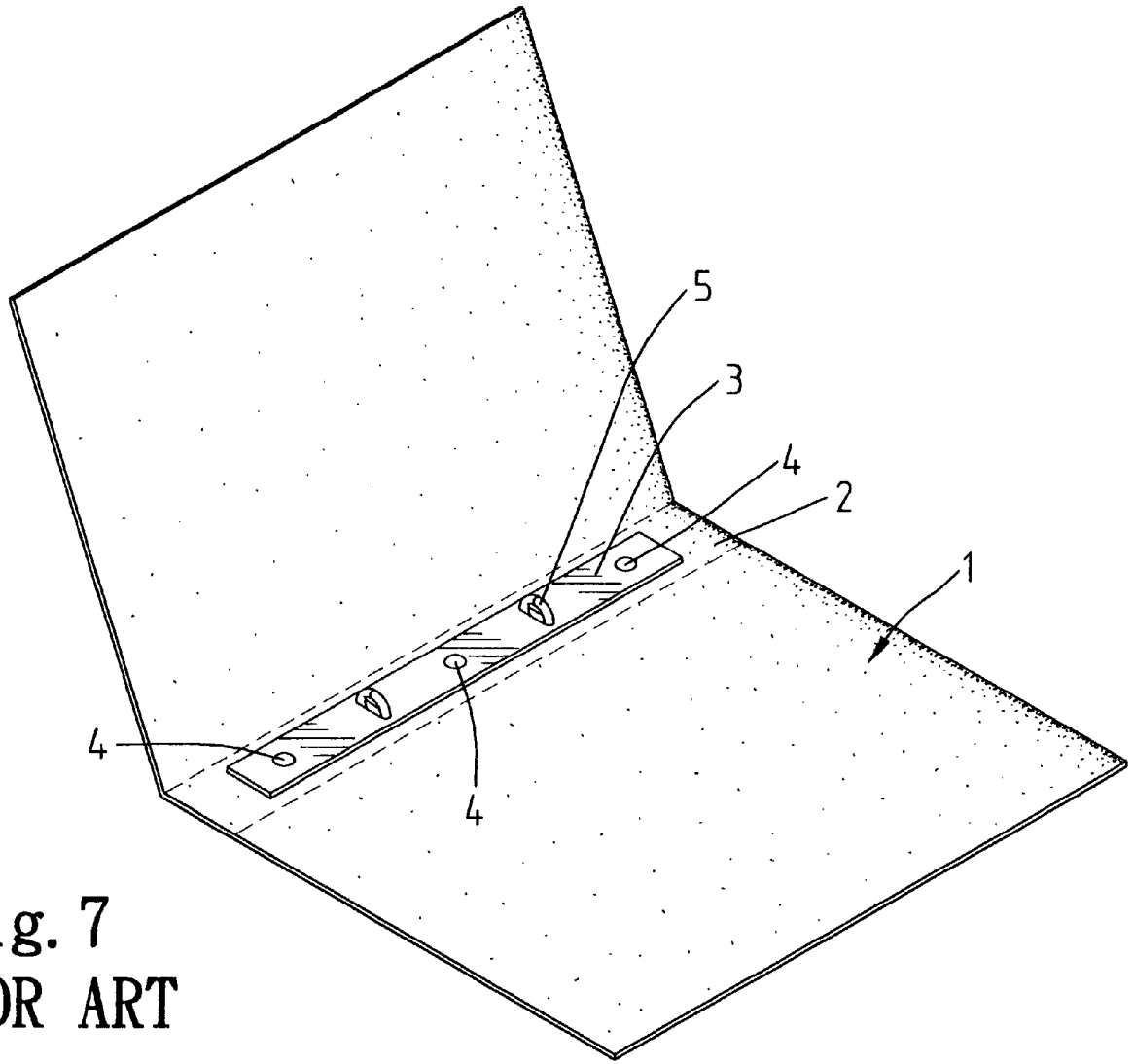
Fig. 7 PRIOR ART
FIG. 7 is a perspective view of a conventional folder.
Figure 8:
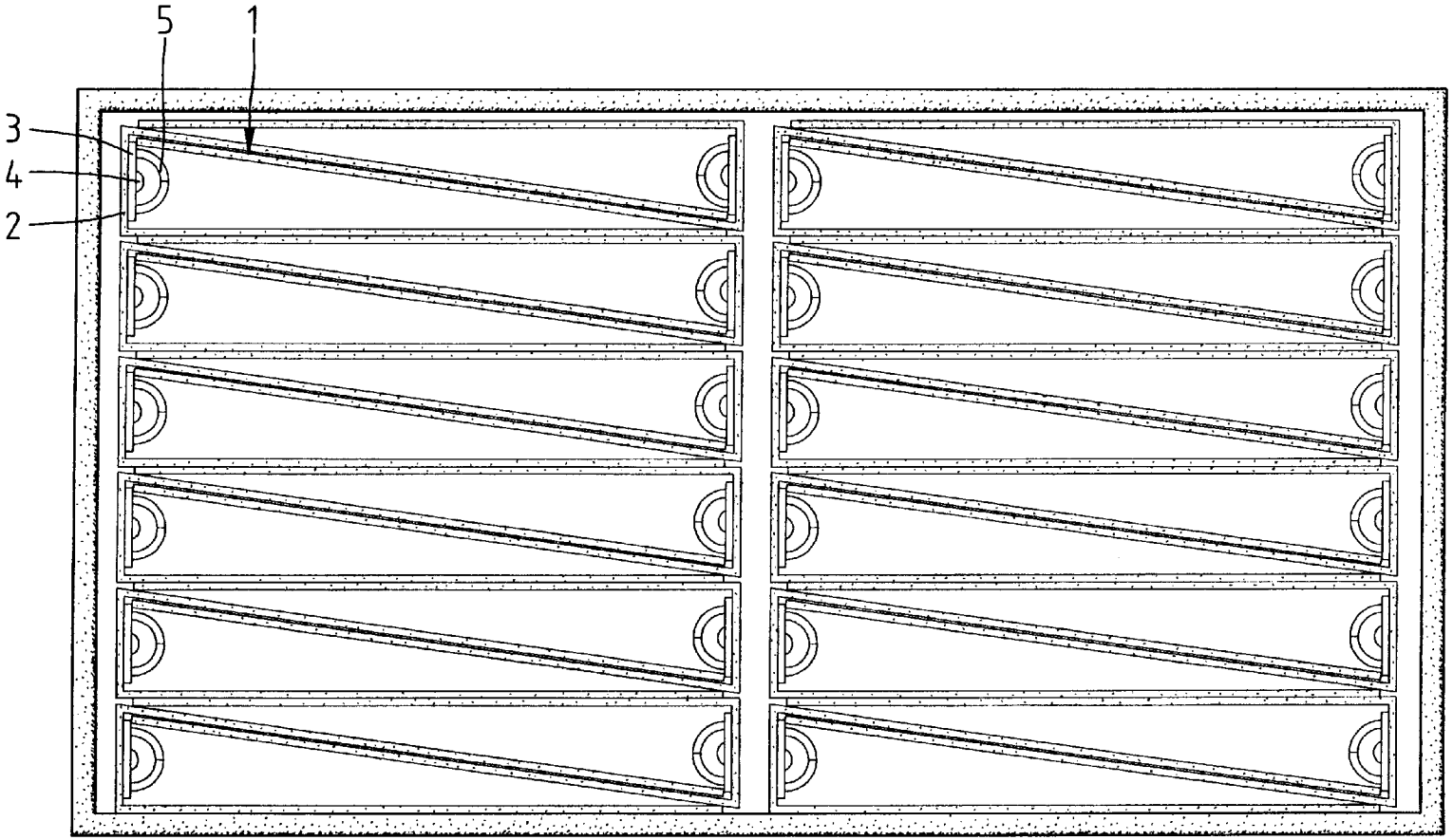
Fig. 8 PRIOR ART
FIG. 8 is a top view of a box containing a small number of conventional folders.

Referring to FIG. 6, a large number of folder apparatuses of the present invention can be packed in a box. Before the folder apparatuses are packed in the box, each of them is dissembled, i.e., the holder 20 is removed from the folder 10 and the folder 10 is completely folded. The term "completely folded" means that a cover 11 is moved against the other cover 11 and the intermediate panel 12 for each folder apparatus. The completely folded folders 10 and the holders 20 are packed in the box. Thus, a large number of folder apparatuses of the present invention can be packed in a box.

The preferred embodiment of the present invention has been described in detail for purposes of illustration. Those skilled in the art can derive a lot of variations from these embodiments after a study of this patent specification. Therefore, these embodiments shall by no means limit the scope of the present invention. The scope of the present invention can only be defined in the claims attached to and taken as a portion of this patent specification.

What is claimed is:

1. A folder apparatus including a folder, a holder for holding leaves and a connector for attaching the holder to the folder in a detachable manner, wherein the holder includes a base attached to the folder in a detachable manner by the connector, wherein the base includes two ends, wherein the connector includes two clips formed on the folder for engagement in a detachable manner with the ends of the base of the holder.

2. The folder apparatus according to claim 1 wherein the holder includes a number of hooks formed thereon.

3. The folder apparatus according to claim 2 wherein the holder includes two pairs of hooks formed thereon.

4. The folder apparatus according to claim 2 wherein the holder includes four pairs of hooks formed thereon.

5. The folder apparatus according to claim 2 wherein the holder includes twelve pairs of hooks formed thereon.

6. The folder apparatus according to claim 1 wherein the folder includes two covers and an intermediate panel interconnecting the covers.

7. The folder apparatus according to claim 6 wherein the connector is formed on the intermediate panel with the two clips formed on the intermediate panel.

* * * * *